US009492849B2

(12) United States Patent
Adams et al.

(10) Patent No.: US 9,492,849 B2
(45) Date of Patent: Nov. 15, 2016

(54) METHOD FOR SORTING PRODUCTS MOVING IN A CONTINUOUS STREAM ON A CHUTE

(75) Inventors: Dirk Adams, Tongeren (BE); Bert Peelaers, Herentals (BE); Bert Dirix, Genk (BE)

(73) Assignee: VISYS NV, Hasselt (BE)

( * ) Notice: Subject to any disclaimer, the term of this patent is extended or adjusted under 35 U.S.C. 154(b) by 1427 days.

(21) Appl. No.: 11/435,037

(22) Filed: May 16, 2006

(65) Prior Publication Data

US 2007/0039856 A1 Feb. 22, 2007

(30) Foreign Application Priority Data

May 17, 2005 (EP) ..... 05447112
Oct. 26, 2005 (EP) ..... 05447239

(51) Int. Cl.
*B07C 5/00* (2006.01)
*B07C 5/36* (2006.01)
*B07C 5/02* (2006.01)

(52) U.S. Cl.
CPC *B07C 5/363* (2013.01); *B07C 5/02* (2013.01)

(58) Field of Classification Search
CPC ..... B07C 5/363; B07C 5/365; B07C 5/366; B07C 5/367; B07C 5/368
USPC ..... 209/576, 644, 44.2, 639
See application file for complete search history.

(56) References Cited

U.S. PATENT DOCUMENTS 2,461,290 A 2/1949 Maynard et al.
3,097,744 A 7/1963 Hutter et al.
3,216,567 A * 11/1965 Kelly et al. ..... 209/571
3,245,530 A 4/1966 Kelly et al.
3,738,484 A 6/1973 Hoover et al.

(Continued)

FOREIGN PATENT DOCUMENTS

CA 1 158 748 12/1983
CA 1242260 9/1988

(Continued)

OTHER PUBLICATIONS

Parberry, R.D., "Optimization of gravity flow discharge chutes for maximum exit velocity under coulomb friction," *Eng. Opt.* (1987) 10: 297-307.

(Continued)

*Primary Examiner* — Joseph C Rodriguez
*Assistant Examiner* — Kalyanavenkateshware Kumar
(74) *Attorney, Agent, or Firm* — Merchant & Gould P.C.

(57) ABSTRACT

The present invention is related to an apparatus for sorting products, in particular granular products such as raisins, blueberries but also pellets e.g. plastic pellets. The sorting apparatus comprises a supply system, a detecting system, a selecting system and a chute. The chute comprises a first guiding element having an upwardly-curved surface for guiding the stream of product moving under influence of gravity towards the detecting system and the selecting system. Optionally the chute comprises a second guiding element having a surface which is downward-curved at least over a certain distance along the movement of the stream of products, such that products which are propelled by the first guiding element and received by the second guiding element are redirected in an essentially vertical downward direction. The detection system will inspect the products when moving in a substantially vertical direction.

8 Claims, 5 Drawing Sheets

(56) References Cited

U.S. PATENT DOCUMENTS

| | | | | |
|---|---|---|---|---|
| 4,194,634 | A | 3/1980 | Kelly | |
| 4,365,719 | A | 12/1982 | Kelly | |
| 4,486,300 | A * | 12/1984 | Prieb | 209/135 |
| 4,600,105 | A | 7/1986 | Van Zyl et al. | |
| 4,634,881 | A | 1/1987 | Billion | |
| 4,723,659 | A | 2/1988 | Billion | |
| 4,863,040 | A | 9/1989 | Sandi | |
| 4,889,241 | A | 12/1989 | Cogan et al. | |
| 5,206,699 | A | 4/1993 | Stewart et al. | |
| 5,297,667 | A | 3/1994 | Hoffman et al. | |
| 5,339,965 | A * | 8/1994 | Klukis et al. | 209/639 |
| 5,344,026 | A | 9/1994 | Booth et al. | |
| 5,351,117 | A | 9/1994 | Stewart et al. | |
| 5,469,973 | A | 11/1995 | Booth et al. | |
| 5,485,964 | A | 1/1996 | Booth et al. | |
| 5,538,142 | A | 7/1996 | Davis et al. | |
| 5,638,961 | A | 6/1997 | Satake et al. | |
| 5,669,511 | A | 9/1997 | Satake et al. | |
| 5,692,621 | A | 12/1997 | Davis et al. | |
| 5,713,456 | A | 2/1998 | Haimberger et al. | |
| 5,873,470 | A | 2/1999 | Davis et al. | |
| 6,040,544 | A * | 3/2000 | Schantz et al. | 209/577 |
| 6,078,018 | A | 6/2000 | Davis et al. | |
| 6,354,440 | B1 * | 3/2002 | Thone et al. | 209/644 |
| 6,640,158 | B1 | 10/2003 | Brandt, Jr. | |
| 2003/0034282 | A1 * | 2/2003 | Safai | 209/582 |
| 2005/0067332 | A1 * | 3/2005 | Ikeda | B07C 5/3422 209/587 |

FOREIGN PATENT DOCUMENTS

| | | |
|---|---|---|
| CH | 303334 | 11/1954 |
| DE | 197 08 457 C1 | 3/1998 |
| EP | 0 341 095 | 11/1989 |
| EP | 0 377 478 | 7/1990 |
| EP | 0 396 290 | 11/1990 |
| EP | 0 705 650 A2 | 9/1995 |
| EP | 0 734 789 A2 | 10/1996 |
| EP | 0 952 895 | 3/2004 |
| GB | 2 084 723 A | 10/1981 |
| NL | 7203430 | 9/1972 |
| WO | WO 92/16312 | 10/1992 |
| WO | WO 96/14168 | 5/1996 |
| WO | WO 96/33929 | 10/1996 |

OTHER PUBLICATIONS

European Search Report for corresponding EPO application 1 726 372 A1, mailed on Sep. 11, 2006.

* cited by examiner

METHOD FOR SORTING PRODUCTS MOVING IN A CONTINUOUS STREAM ON A CHUTE

PRIORITY

This application claims priority to European applications EP05447112 filed on May 17, 2005 and EP05447239 filed on Oct. 26, 2005.

FIELD OF THE INVENTION

The present invention relates to a chute for a sorting apparatus, said chute being provided with an inclined surface for guiding products, in particular granular products, towards a detecting and selecting system of the sorting apparatus while moving under influence of gravity. It also relates to an apparatus for sorting products comprising such a chute.

STATE OF THE ART

A sorting apparatus for in-line sorting of granular products is disclosed in European patent EP0952895. This sorting apparatus comprises a detection system, a removal system and a transport device having a sloped distribution surface, which is convex over at least a certain distance in the direction of travel of the granular products. This transport device guides the products towards the detection and removal system such that products are analysed and selected while moving in a vertical downward direction. The curvature of this convex distribution surface is equal to or slightly less than then curvature of the path the falling products would follow if this convex distribution surface would be absent. It is claimed that this particular shape of the distribution surface forces the falling products to follow substantially congruent parabolic paths such that the position and speed of each falling product is predetermined, thereby rendering the process of analysing and selecting the falling products more easy. Although this convex shape is present, there is still a large variation on the trajectories of the falling products such that the spacing between the removal system and the falling products cannot be minimised, thereby resulting in an unwanted removal of high-quality products. The variation on the trajectory, i.e. position and speed, of each individual product renders the synchronisation of the detection system and the removal system more difficult. Moreover due to the convex shape of the distribution surface it is difficult to stabilise the orientation of the falling products towards the detection system such that a maximal projected area of the product is offered for analysis. Certainly if hard products are being transported such products tend to bounce on the distribution surface thereby following a path that deviates from the desired congruent parabolic path. Products having a trajectory, which differs from the mean congruent path of the product stream, may be deposited upon the detection system and consequently the quality of the detection system can be impaired.

Another sorting apparatus is disclosed in German patent DE19708457. This sorting apparatus also comprises a detection system, a removal system and a chute having a curved surface in the shape of a ski jump having a monotonic increase of the curvature of this surface towards the detection system. This chute projects the products in an upward direction towards the detection and removal system such that the products are analysed and selected while moving in a horizontal forward direction. It is claimed that while gliding downwards along the curved surface of the chute the position of the products is stabilised due to the centrifugal forces acting thereupon. Although a more stabile product stream can be obtained, the projection of the products in a upward direction when leaving the chute introduces variation on the trajectory of projected products which makes the subsequent analysis and removal process more complex and less selective. Also here the position of the detection system makes it more prone to be dirtied by products having a trajectory, which differs from the mean path of the product stream, and consequently the quality of the detection system can be impaired.

AIMS OF THE INVENTION

The present invention aims to provide a chute that overcomes the above problems of the prior art solutions. In another aspect the invention aims to provide a sorting apparatus equipped with such a chute.

SUMMARY OF THE INVENTION

The present invention relates to a chute adapted for guiding a stream of products, moving under influence of gravity, in an essentially vertical downward direction allowing the analysis and selection of the products while in free fall. As the products are stabilised while moving along the chute the selection process can be performed more accurately, thereby reducing unwanted removal of good products or bad products not being removed. The chute configuration also offers a better control over the trajectory of the falling products such that the spacing between the selecting system and the product stream can be minimised.

In a first embodiment of the invention a chute is disclosed comprising a first guiding element. This first guiding element has a upwardly curved surface over its entire length towards the detection system, i.e. along the direction in which the products propagate. If this surface is expressed by a function $P_1$, this means in particular, that for the second derivative of this function $P_1$ it holds that $d^2 P_1/dx^2 \geq 0$ over the complete width of said first guiding element.

In a preferred embodiment the dimensions of the first guiding element are selected from the following ranges:

- the height of the first guiding element measured between point (I) and point (E), is selected from the range 0.3 m to 0.8 m, and is preferably at about 0.5 m and
- the width of the first guiding element, i.e. the horizontal distance between point (I) and point (E), is selected from the range 0.05 m to 0.4 m, preferably selected from the range 0.05 m to 0.2 m, and is preferably about 0.15 m, and
- the angle $\alpha$ is selected from the range 70 to 90 degrees, preferably selected from the range 80 to 90 degrees, more preferably this angle is about 90 degrees, and
- the angle $\beta$ is selected from the range 20 to 85 degrees, preferably selected from the range 40 to 85 degrees and is preferably about 80 degrees.

In another embodiment the curvature of this first guiding element can be described by a B-spline function having a knot sequence given by $K_1=[0\ 0\ 0\ 0\ \kappa\ l\ l\ l\ l]$, where 0 is the origin, $\kappa$ is a sliding knot controlling the curvature and l is the horizontal dimension of the first guiding element, further specified by the following constraints: $P_1(0)=0$, $P_1(l)=h$, $P_1(\kappa)=\kappa_y$, $DP_1(0)=\tan\alpha$, $DP_1(l)=\tan\beta$. $DP_1$ hereby denotes the first derivative.

In an advantageous embodiment the chute comprises, in addition to the first guiding element, a second guiding element. This second guiding element has a surface which is adapted for redirecting products which are propelled by the first guiding element towards the second guiding element and received by the second guiding element in an essentially vertical downward direction.

The surface of the second guiding element curves downwardly over at least a certain section along the movement of the product stream such that products propelled towards this downwardly curved section are redirected by this downwardly curved section in an essentially vertical downward direction. As the stream of products when being propelled towards this downwardly curved section is characterised by a mean velocity vector, the surface of the second guiding element is preferably shaped to be initially tangential to this mean velocity vector.

In a specific embodiment the second guiding element is curved in the downward direction over its entire length.

In another embodiment the second guiding element has downstream a downwardly curved section parallel with the product stream and upstream an upwardly-curved section.

In a preferred embodiment a chute provided with a first and a second guiding element has dimensions selected from the following ranges:

- the height of the chute, i.e. the vertical distance between point (I) and point (m), is selected from the range 0.1 m to 1.2 m, whereby
  - the height of the first guiding element, measured between point (I) and point (E), is selected from the range 0.3 m to 0.8 m, and
  - the height of the second guiding element, measured between point (n) and point (m), is selected from the range 0.05 m to 0.4 m,
- the width of the chute, i.e. the horizontal distance between point (I) and point (m), is selected from the range 0.15 m to 0.7 m., whereby
  - the width of the first guiding element, measured between point (I) and point (E), is selected from the range 0.05 m to 0.4 m, and
  - the width of the second guiding element, measured between point (n) and point (m), is selected from the range 0.02 m and 0.3 m.,
- the angle $\alpha$ is selected from the range 70 to 90 degrees and is preferably about 80 degrees, and
- the angle $\beta$ is selected from the range 20 to 60 degrees and is preferably about 50 degrees.

In another embodiment the curvature of the second guiding element can be described by a spline function characterised by the following control points:

$$CP_{P_2} = \begin{bmatrix} m_x & m_x & U & n_x & n_x \\ m_y & T_U(m_x) & \Phi(U) & T_U(n_x) & n_y \end{bmatrix}$$

In another aspect the present invention discloses an apparatus for sorting products, in particular granular products such as raisins, blueberries but also pellets e.g. plastic pellets. The sorting apparatus comprises a supply system for providing products in a continuous stream to a chute as previously described. This chute guides the supplied products, while moving under gravity, towards a detection system and a removal system, the chute comprising a first guiding element having an upwardly-curved surface and, optionally, a second guiding element as in the above-mentioned embodiments of the invention. The detection system is positioned to analyse the products when moving in a substantially vertical direction. Preferably the configuration of the sorting apparatus is such that the first guiding element is positioned on one side of the product stream and the removal system and, if present, the second guiding element is positioned at the opposite side of the product stream.

SHORT DESCRIPTION OF THE DRAWINGS

For the purpose of teaching the invention schematic viewings and cross-sections of a sorting apparatus or chute according to various embodiments of the invention are given. These drawings are not to scale. Like numerals are given to like elements in each drawing.

DETAILED DESCRIPTION OF THE INVENTION

The present invention discloses an apparatus for sorting products, in particular granular products such as raisins, blueberries but also pellets e.g. plastic pellets, which are supplied in a continuous stream. In particular the present invention discloses a chute for guiding the stream of products when moving in a vertical downward direction due to gravity, which can be used in such sorting apparatus.

Figure 1:
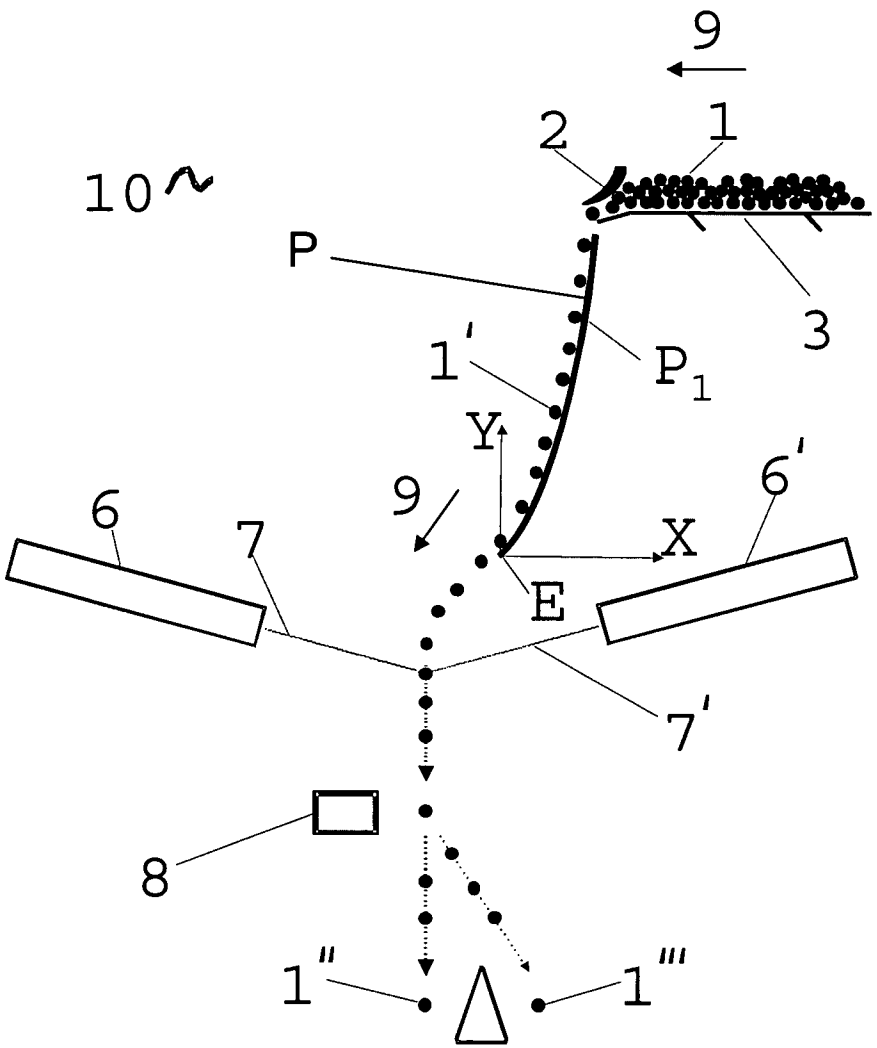
FIG. 1 represents a schematic view of a sorting apparatus according to an embodiment of the invention.

FIG. 1 illustrates a sorting apparatus (10) according to a first embodiment of the present invention. This apparatus for sorting products (1) comprises a supply system (3), at least one detection system (6,6'), a removal system (8) and a chute (P) which guides the stream of products, supplied by the supply system (3), towards the detection system (6, 6') and the removal system (8) while moving under influence of gravity. This supply system (3) can be a conveyor belt, a shaker, a vibrating table or any transporting means known in the art. After leaving the chute (P) the product granules are individually scanned by a detection system (6, 6'), preferably both from a front (6) and a rear position (6'). The detection system (6, 6') can comprise at least one light source directing a concentrated light beam (7, 7'), such as a laser beam, for scanning the products (1') and at a least one detector, such as a photo multiplier tube, but likewise a CCD camera is suitable as well, for receiving light reflected from the products (1'). In any case the sensed signal will be analysed and lesser quality products or foreign bodies will be detected. When the decision is taken to remove certain products from the product flow, a signal is given to the removal system (8). Typically this removal system (8) is a manifold of air pressure valves which can be opened on command. This allows the rejected element (1") to be blown out of the product stream as soon as it enters the cone of high pressured air produced by such a valve, while the accepted elements (1''') continue their movement. The present invention is however not limited to an air pressure based removal system. Optionally an element (2) can be mounted above the supply system (3) at the point where the products (1) are transferred from the supply system (3) to the chute (P). The products (1) when going from the supply system (3) to the chute (P) will be pushed again this element (2) such that products are more uniformly distributed over the product stream and a thinner product stream towards the chute (P) is obtained. This element (2) can be a flexible flap mounted on a horizontal axis and which is made of rubber, plastic, leather or any kind of flexible material known in the art. This axis is located at the end of the supply system (3) adjacent the chute (P) and is perpendicular to the direction (9) in which the products (1) are being propagated.

The first guiding element ($P_1$) of the chute (P) has an upwardly-curved surface. The first guiding element ($P_1$) has a surface which is upwardly-curved over its entire length towards the detection system (6, 6'), i.e. along the direction (9) in which the products (1') propagate. The products will fall from the supply system (3) on the chute (P) and glide downwards to the detection system (6, 6'), the position of the products being stabilised due to the centrifugal forces acting thereupon. When leaving the chute (P) at its bottom point, the stream of products will have a substantially uniform thickness, with a small thickness distribution in a direction perpendicular to the chute (P). Typically the thickness of the product stream is substantially equal to the thickness of a single product (1). The first guiding element ($P_1$) of the chute (P) illustrated in FIG. 1 thus has a upward parabolic surface such that the chute is upwardly sloped over its entire length along the propagation direction (9) of the products (1'). As can been seen in FIG. 1 first guiding element ($P_1$) of the chute (P) is shaped such that when the falling products (1') leave the chute (P), they are propelled downward towards the detection system (6, 6'). At the bottom end (E) of the first guiding element ($P_1$) of the chute (P), each granule normally has a nominal speed of approximately 2 m/s. At that point E the product goes into free-fall thereby describing a parabolic curve. Following this parabolic path the products (1') will finally propagate in an essentially vertical downward direction. From this point onwards products (1') will be analysed by the detection system (6, 6'). As shown in FIG. 1, the concentrated light beam (7, 7') of the detection system (6, 6') is directed to the product stream where propagating in an essentially vertical direction.

As can be seen in FIG. 1 the chute (P) is positioned below the product stream to carry the product stream. Due to this configuration one can position the removal system (8) downstream the product stream and opposite the side where the chute (P) is placed. The removal system (8) can even be positioned such that the distance between the removal system (8) and the product stream is minimised. Given the fact that the product stream is more confined, the average distance between the removal system (8) and the free-falling products can be greatly reduced. Thus if the removal system (8) comprises a manifold of air-pressure valves, which often is the case, the effective removal area of one such valve at this short distance from the falling product is, contrary to prior art sorting apparatus, no more much larger than the size of a typical granule such as a raisin or a peanut. As a result the false reject, i.e. the amount of good product which has been removed, is considerably reduced.

Figure 2:
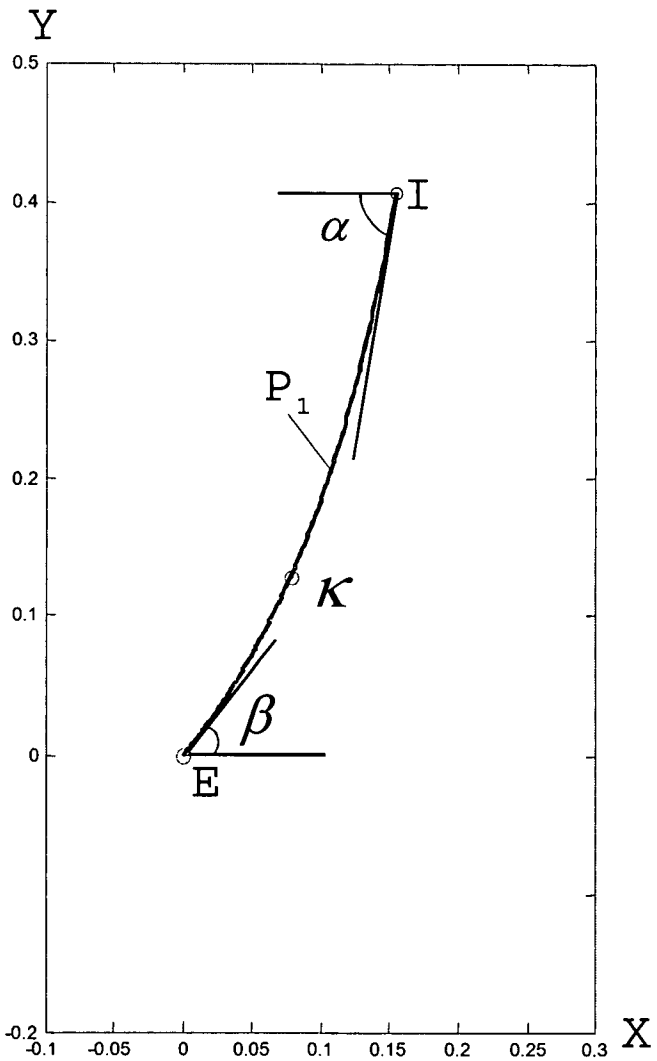
FIG. 2 represents a schematic view of the chute illustrating the parameters determining the shape and relative position of the first guiding element of the chute.

To further illustrate the invention, a detailed description is given below to determine the configuration of the first guiding element ($P_1$) of a chute (P) according to a first embodiment of the invention, the shape of which can be selected according to the description given below. FIG. 2 illustrates the mathematical modelling of this first guiding element ($P_1$).

The curvature of this first element ($P_1$) is fully described by a B-spline $P_1$. By convention the origin of this B-spline function is placed on the outgoing point of the first guiding element ($P_1$), i.e. at is lowest point E. The knot sequence describing $P_1$ is given by $$K_1=[0\ 0\ 0\ 0\ \kappa l\ l\ l\ l] \tag{1}$$

where 0 is the origin, κ is a sliding knot with which we can control the curvature and l is the width of the first element ($P_1$), i.e. its horizontal dimension. The following constraints are further specified: $P_1(0)=0$, $P_1(l)=h$, $P_1(\kappa)=\kappa_y$, $DP_1(0)=\tan\alpha$, $DP_1(l)=\tan\beta$. The first derivative $dP_1/dx$ is hereby denoted $DP_1$.

In this set-up it is clear that $P_1$ describes a cubic spline, i.e. the number of knots minus the number of constraints is four. The current invention is however not limited to this particular mathematical formulation, as long as the first guiding element ($P_1$) is downwardly sloped over its entire length along the propagation direction (9) such that the products (1') are leaving the first guiding element ($P_1$) in a direction which is equal or less than the horizontal direction X as shown in FIG. 1.

The gravitational force F, as a function of x, acting on a granule which glides along a surface described by $P_1$ is given by $$F(x) = Mg\cos\left(\arctan\frac{dP_1}{dx}\right), \tag{2}$$

where g is the acceleration due to gravitation. Because one is only interested in the speed of a granule at the point where it leaves the first guiding element ($P_1$), M can be assumed to be one, i.e. the speed is independent of mass.

The work done by a granule following the path $P_1$ can be expressed as $$W = \int_{P_1} F(s)ds \tag{3}$$

where s denotes the parameter space in which $P_1$ and F are described. In a Cartesian system with x- and y-axes this becomes $$W = \int_l^0 F(x)\sqrt{1+(dP_1/dx)^2}\,dx. \tag{4}$$

Finally one can calculate the speed at any position on the surface described by $P_1$ as $$v(x)=\sqrt{2W}. \tag{5}$$

In particular applications where products are sticky or have a tendency to deposit dirt at least on the first guiding element ($P_1$), it can be taken into account that not all work is converted into kinetic energy. The speed of such a product is then given by $$v_{min}(x)=\sqrt{2(1-\lambda_p)W}, \tag{6}$$

where $\lambda_p$ is product specific and indicates the tendency of that product to stick or deposit dirt and hence to increase the friction along the first guiding element ($P_1$).

If the product enters the first guiding element ($P_1$) of the chute (P) having a given speed $v_0$, the resulting speed is calculated as $$v_{max}(x)=\sqrt{2W+v_0^2}. \tag{7}$$

Once the product leaves the first guiding element ($P_1$), it enters a free-fall curve described by $$\Phi(x) = x\tan\beta - \frac{gx^2}{2v(E)\cos^2\beta}, \tag{8}$$

where v(E) denotes the speed of a granule when it leaves the first guiding element ($P_1$).

The tangent line at a certain point X is then given by $$T_X(x) = \frac{d\Phi}{dx}(X)(x-X)+\Phi(X) \tag{9}$$

Preferably the dimensions of the first guiding element are selected from the following ranges:

- the height of the first guiding element ($P_1$) measured between point (I) and point (E), is selected from the range 0.3 m to 0.8 m, and is preferably at about 0.5 m and
- the width of the first guiding element ($P_1$), i.e. the horizontal distance between point (I) and point (E), is selected from the range 0.05 m to 0.4 m, preferably selected from the range 0.05 m to 0.2 m, and is preferably about 0.15 m, and
- the angle α, indicative for the slope of the first guiding element ($P_1$) near the supply system (3) and measured counter clockwise relative to the horizontal axis, is selected from the range 70 to 90 degrees, preferably selected from the range 80 to 90 degrees, more preferably this angle is about 90 degrees, and
- the angle β, indicative for the slope of the first guiding element ($P_1$) at the end remote from the supply system (3) and measured clockwise relative to the horizontal axis, is selected from the range 20 to 70 degrees, preferably selected from the range 40 to 85 degrees and is preferably about 80 degrees.

In a preferred embodiment of the first aspect to the invention, the speed of a product at point (E) is v(E)=1.7 m/s. The angle α should preferably be between 70 and 90 degrees, preferably selected from the range 80 to 90 degrees, more preferably this angle is about 90 degrees. The angle β is selected from the range 20 to 85 degrees, preferably selected from the range of 40 to 85 degrees and is preferably about 80 degrees.

The knot ($\kappa,\kappa_y$) is varied to such an extent that the first guiding element ($P_1$) of the chute (P) is concave in the downward direction. This means in particular that for the second derivative of $P_1$ it holds that $d^2P_1/dx^2 \geq 0$ over the complete horizontal interval or width (I, E) of the first guiding element ($P_1$) of the chute (4). This means in particular that for the first derivative of P1 it holds that $dP_1/dx>0$. In a preferred embodiment of the invention the knot ($\kappa,\kappa_y$) is taken to be (0.0779 m, 0.1279 m), measured in an XY reference system as depicted in FIG. 2.

Figure 3:
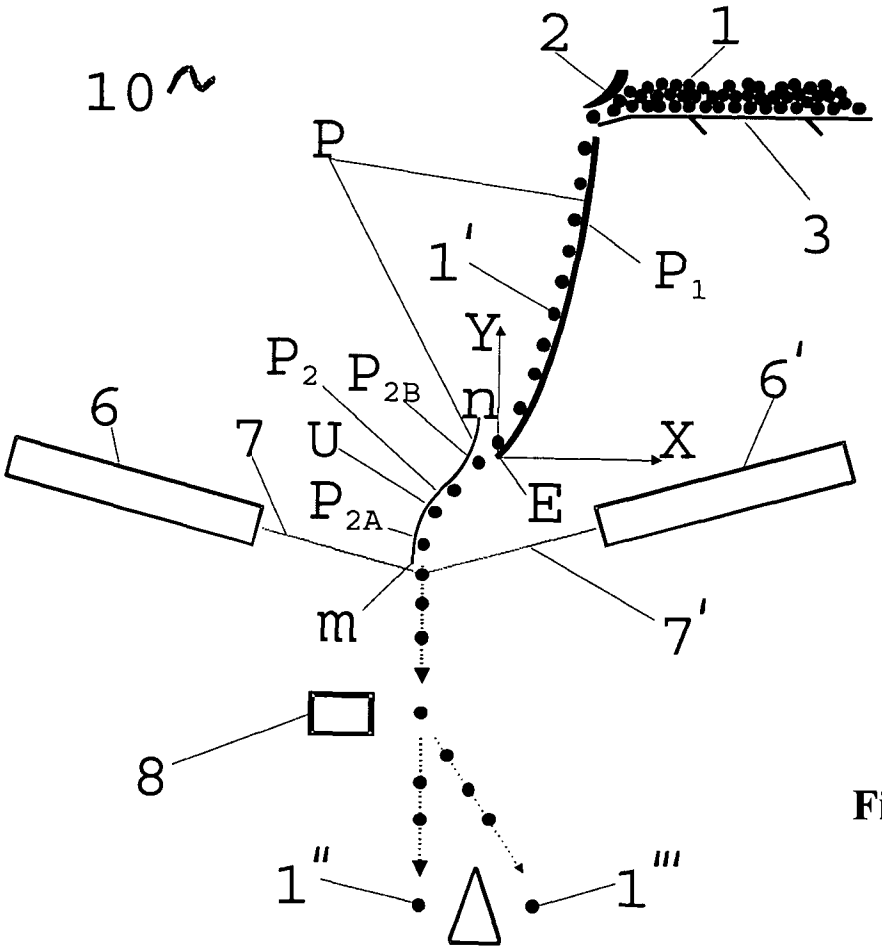
FIG. 3 represents a schematic view of a sorting apparatus provided with a first and a second guiding element according to an embodiment of the invention.

FIG. 3 illustrates a sorting apparatus (10) according to another preferred embodiment of the present invention. The sorting apparatus comprises a supply system (3), a detection system (6,6'), a removal system (9) and a chute (P) which guides the stream of products, supplied by the supply system (3), towards the detection system (6, 6') and the removal system (8) while moving under influence of gravity. This supply system (3) can be a conveyor belt, a shaker or any transporting means known in the art. After leaving the chute (P) the product granules are individually scanned by a detection system, preferably both from a front (6) and a rear position (6'). The detection system can comprise a laser and a photo multiplier tube, but likewise a CCD camera is suitable as well. In any case the sensed signal will be analysed and lesser quality product or foreign bodies will be detected. When the decision is taken to remove certain products from the product flow, a signal is given to the removal system (8). Typically this removal system (8) is a manifold of air pressure valves which can be opened on command. This allows the rejected element (1") to be blown out of the product stream as soon as it enters the cone of high pressured air produced by such a valve, while the accepted elements (1''') continue their movement. The present invention is however not limited to an air pressure based removal system optionally a element (2) can mounted above the supply system (3) at the point where the products (1) are transferred from the supply system (3) to the chute (P). The products (1) when going from the supply system (1) to the chute (P) will be pushed again this element (2) such that products are more uniformly distributed over the product stream and a thinner product stream towards the chute (P) is obtained.

The chute (P) comprises a first guided element ($P_1$) as previously discussed, which has an upwardly-curved surface surface and further a second guiding element ($P_2$) having a downwardly-curved surface. The products will fall from the supply system (3) on the first guiding element ($P_1$) and glide downwards to the second guiding element ($P_2$). The chute illustrated in FIG. 3 thus comprises upstream a first guiding element ($P_1$) having an upward parabolic surface and downstream a second guiding element ($P_2$), at least one section ($P_{2A}$) thereof has a downward parabolic surface. As can be seen in FIG. 3 both guiding elements ($P_1$, $P_2$) are positioned with respect to each other, such that when the falling products (1') leave the first guiding element ($P_1$) they are propelled towards the second guiding element ($P_2$) to be received thereby ($P_{2A}$). At the bottom end (E) of the first guiding element ($P_1$), each granule normally has a nominal speed of approximately 2 m/s. At that point E the product goes into free-fall thereby describing a parabolic curve. Following this parabolic path the product will reach the second guiding element ($P_1$) at a predetermined point (U). From that point onwards the second guiding element ($P_2$) will guide the product to an essentially vertical downward direction.

The receiving section ($P_{2A}$) of this second guiding element ($P_2$) is shaped to be initially parallel with the mean velocity vector of the incoming product stream thereby minimising the risk of the products to bounce back upon impact with the second guiding element ($P_2$). Due to its convex shape the second guiding element ($P_2$) first receives the products at point (U) and then redirects them in a vertically downward direction. The velocity vector (V) of the propelled products as determined by the curvature of the first guiding element ($P_1$) is gradually redirected from a more horizontal direction to a vertical direction thanks to the smoothly curved surface of the second guiding element ($P_2$) resulting in a free fall of the products with well controlled position and speed. Hence the trajectories of the falling products are better controlled thereby reducing the spread thereof. In a chute with two guiding elements ($P_1$, $P_2$) according to the present invention, the second guiding element ($P_2$) will substantially minimise the spinning of the falling products such that shape detection of these products can be done more accurately.

Figure 5:
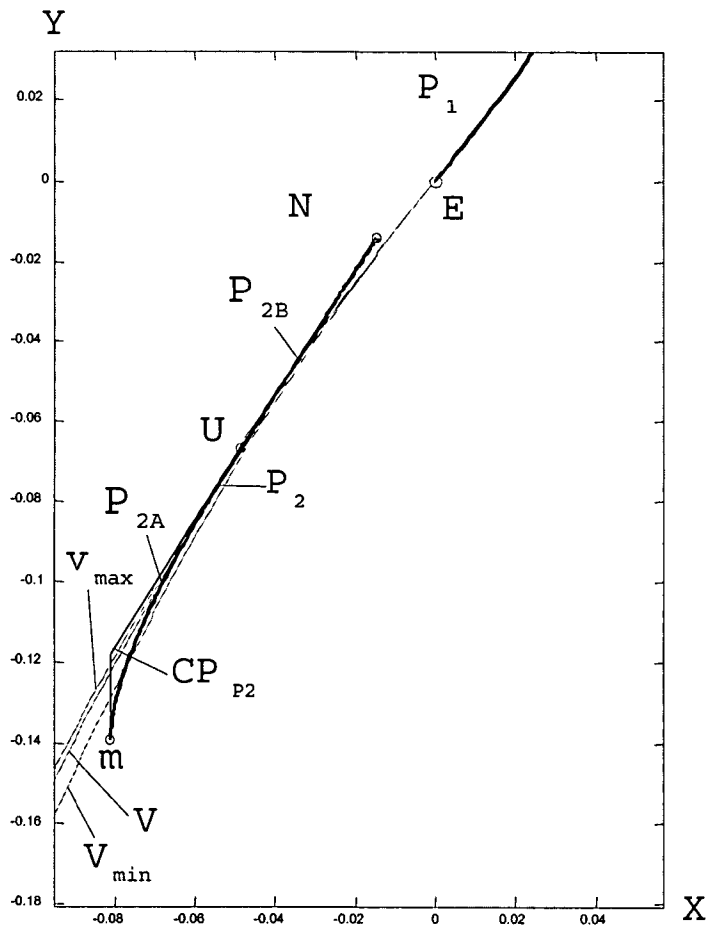
FIG. 5 represents a detailed schematic view of the chute illustrating a particular shape and relative position of the first and second guiding element of the chute according to the present invention.

As shown in FIG. 3 the second guiding element ($P_2$) need only to have a section ($P_{2A}$) with an upwardly curved surface from impact point (U) downwards. All trajectories of the propelled product should reach the second guiding element ($P_2$) at this point (U) or below. However some outlier products may have a deviating trajectory which leads them above this point (U). These products will then be lost. Optionally a second section ($P_{2B}$) can be placed in the second guiding element ($P_2$) at a position above this point (U). This upstream section ($P_{2B}$) preferably has an upward parabolic shape as shown in FIG. 3. Due to its shape this second section ($P_{2B}$) will prevent such outliers from travelling beyond the second guiding element ($P_2$) by either bouncing them back to the first guiding element ($P_1$) or by guiding them directly to the downstream section ($P_{2A}$). However as shown in FIG. 5 this section ($P_{2B}$) can be designed to have a straight shape which is more or less parallel to the trajectory of the incoming products. The latter alternative might be easier to manufacture as the second guiding element ($P_2$) can then be constructed from a straight plate only requiring one end of it ($P_{2A}$) to be curved according to the required specifications.

As can be seen in FIG. 3 the first guiding element ($P_1$) is positioned below the product stream to carry the product stream, while the second guiding element ($P_2$) is positioned downstream and above the product stream to prevent the propelled products to move further in horizontal direction. Due to this configuration one can position the removal system (8) downstream and at the same side as the second guiding element ($P_2$) as it this second guiding element ($P_2$) will prevent residues or products being deposited on the removal system (8). The removal system (8) can even be positioned parallel in vertical direction with the second guiding element such that the distance between the removal system (8) and the product stream is minimised. Given the fact that the product stream is more confined the average distance between the removal system (8) and the free-falling products can greatly reduced. Thus if the removal system (8) comprises a manifold of air-pressure valves, which is often the case, the effective removal area of one such valve at this short distance from the falling product is, contrary to prior art sorting apparatus, no more much larger than the size of a typical granule such as a raisin or a peanut. As a result the false reject, i.e. the amount of good product which has been removed, will be considerably reduced.

Although not shown in FIG. 3 optional features can be foreseen to adjust the position of the second guiding element ($P_2$) in the vertical and/or horizontal direction to allow varying the relative position of the second guiding element ($P_2$) to the first guiding element ($P_1$) as will be appreciated by any person skilled in the art.

Figure 4:
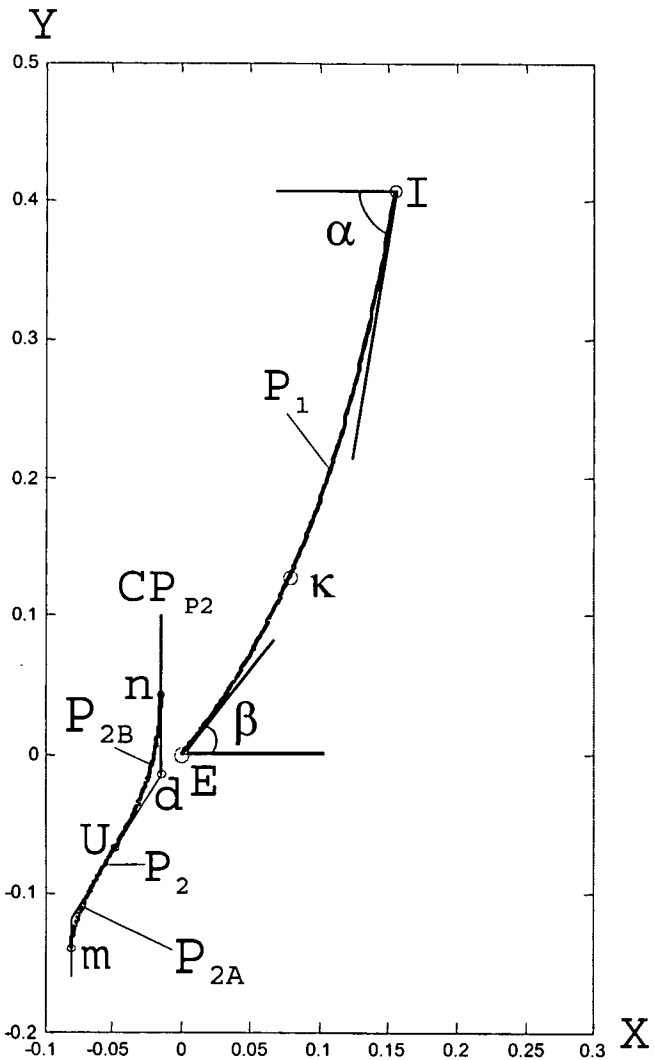
FIG. 4 represents a schematic view of the chute illustrating the parameters determining the shape and relative position of the first and second guiding element of the chute.

To further illustrate the invention, a detailed description is given below to determine the configuration of a chute (P) according to this second aspect of the invention: the shape and the relative position of each guiding element ($P_1$, $P_2$) can be selected according to the description given below. FIG. 4 illustrates the mathematical modelling of the both elements ($P_1$, $P_2$).

The curvature of the first element (P1) is fully given by a B-spline $P_1$. By convention the origin is placed on the outgoing point of the first plate. The knot sequence describing $P_1$ is given by $$K_1=[0\ 0\ 0\ 0\ \kappa\ l\ l\ l\ l] \tag{10}$$

where 0 is the origin, κ is a sliding knot with which we the curvature can be controlled and l is the length of the first guiding element ($P_1$), i.e. its horizontal dimension. The following constraints are further specified: $P_1(0)=0$, $P_1(l)=h$, $P_1(\kappa)=\kappa_y$, $DP_1(0)=\tan\alpha$, $DP_1(l)=\tan\beta$. In this set-up it is clear that $P_1$ describes a cubic spline, i.e. the number of knots minus the number of constraints is four. The present invention is however not limited to this particular mathematical formulation.

The gravitational force, as a function of x, acting on a granule which glides along $P_1$ is given by $$F(x) = Mg\cos\left(\arctan\frac{dP_1}{dx}\right), \tag{11}$$

where g is the acceleration due to gravitation. Because one is only interested in the speed of a granule at the point where it leaves $P_1$, M can be assumed to be one (i.e. the speed is independent of mass).

The work done by a granule following the path $P_1$ can be expressed as $$W = \int_{P_1} F(s)ds, \tag{12}$$

where s denotes the parameter space in which $P_1$ and F are described. In a Cartesian system with x- and y-axes this becomes $$W = \int_l^0 F(x)\sqrt{1+(dP_1/dx)^2}\,dx. \tag{13}$$

Finally one can calculate the speed at any position on $P_1$ as $$v(x)=\sqrt{2W}. \tag{14}$$

In particular applications where products are sticky or have a tendency to deposit dirt on the chute (P), it can be taken into account that not all work is converted into kinetic energy. The speed of such a product is then given by $$v_{min}(x)=\sqrt{2(1-\lambda_p)W}, \tag{15}$$

where $\lambda_p$ is product specific and indicates the tendency of that product to stick or deposit dirt and hence to increase the friction along $P_1$.

If the product enters the chute (P) having a given speed $v_0$, the resulting speed is calculated as $$v_{max}(x)=\sqrt{2W+v_0^2}. \tag{16}$$

Once the product leaves $P_1$ it enters a free-fall curve described by $$\Phi(X) = x\tan\beta - \frac{gx^2}{2v(E)\cos^2\beta}, \tag{17}$$

where v(E) is the speed of a granule when it leaves $P_1$.

The tangent line at a certain point X is then given by $$T_X(x) = \frac{d\Phi}{dx}(X)(x-X)+\Phi(X) \tag{18}$$

To determine the shape of the second guiding element ($P_2$), a suitable point (U) is chosen for which the following holds $$\frac{d\Phi}{dx}(U) = \frac{dP_2}{dx}(U). \tag{19}$$

Typically $U=l_2/2$, where $l_2$ is the length of the second plate along the x-axis.

Finally, the control points of the spline function $P_2$, fully describing the shape of the second guiding element ($P_2$,), are defined as follows $$CP_{P_2} = \begin{bmatrix} m_x & m_x & U & n_x & n_x \\ m_y & T_U(m_x) & \Phi(U) & T_U(n_x) & n_y \end{bmatrix} \tag{20}$$

Here $$\begin{pmatrix} n_x \\ n_y \end{pmatrix} \text{ and } \begin{pmatrix} m_x \\ m_y \end{pmatrix}$$

are the rightmost (n) and leftmost (m) points on the second plate ($P_2$), respectively. The control points $CP_{P_2}$ ensure that the outgoing direction of granules along $P_2$ is vertical.

The vertical distance between point (I) and point (m), i.e. the height of the chute (P), can vary between 0.1 m and 1.2 m. The height of the first guiding element ($P_1$), measured between point (I) and point (E), is preferably between 0.3 m and 0.8 m and the height of the second guiding element ($P_2$), measured between point (n) and point (m), is preferably between 0.05 m and 0.4 m.

The horizontal distance between point (I) and point (m), i.e. the width of the chute (P), can vary between 0.15 m and 0.7 m. The width of the first guiding element (P1), measured between point (I) and point (E), is preferably between 0.05 m and 0.4 m and the width of the second guiding element (P2), measured between point (n) and point (m), is preferably between 0.02 m and 0.3 m.

In one embodiment of the present invention $n_y=d_y=T_U(n_x)$, in other words the points (n) and (d) coincide. This produces a guiding element ($P_2$), which is shaped completely convex in the downward direction of gravitation. This selection of parameters thus results in a second guiding element ($P_2$) of the chute (P) having only the downstream section ($P_{2A}$) curved. This embodiment is illustrated in FIG. 5.

In a preferred embodiment of the present invention, the speed of a product at point (E) is v(E)=1.7 m/s. The angle α, indicative for the slope of the first guiding element ($P_1$) near the supply system (3) and measured counter clockwise relative to the horizontal axis, should preferably be between 70 and 90 degrees and more preferably about 80 degrees. The angle β, indicative for the slope of the first guiding element ($P_1$) at the end remote from the supply system (3) and measured clockwise relative to the horizontal axis, is preferably between 20 and 60 degrees and more preferably about 50 degrees.

The knot (κ, $\kappa_y$) is varied to such an extent that the first guiding element ($P_1$) of the chute (P) is concave in the downward direction. This means in particular that for the second derivative of $P_1$ it holds that $d^2P_1/dx^2 \geq 0$ over the complete horizontal interval or width (I, E) of the first guiding element ($P_1$) of the chute (4). This means in particular that for the first derivative of P1 it holds that $dP_1/dx>0$. In a preferred embodiment the knot (κ,$\kappa_y$) is taken to be (0.0799 m, 0.1279 m), measured in an XY reference system such as depicted in FIG. 4.

The invention claimed is:

1. A method for sorting products, comprising:

supplying a continuous stream of products to be sorted, wherein the stream of products includes individual products each having a given thickness dimension;

providing a chute, the chute having a receiving end and a distal end located below the receiving end, the chute having an upwardly curved surface extending between the receiving end and the distal end, the surface being shaped to define a product path curving upwardly along the surface of the chute and after the products leave the chute at the distal end, the product path having a convex portion extending at the distal end of the chute in a direction below horizontal the direction of the product path at the distal end of the chute being defined by an angle between horizontal and a tangent to the chute at the distal end of 40-85 degrees, and an essentially vertical portion along a downward path;

delivering the continuous stream of products to the chute, wherein the continuous stream of products slides along the chute under the influence of gravity to the distal end, and wherein centrifugal forces act on the stream of products to stabilize the position of the products;

creating a planar product stream from the continuous stream of products having a thickness which is equal to the thickness of a single product, said planar product stream appearing at the distal end of the chute and propagating along said convex portion and said essentially vertical portion of the product path;

analyzing said products when propagating along the product path in the essentially vertical portion and identifying defective products by a detection system; and removing said defective products from the planar product stream by a removal system.

2. The method according to claim 1, wherein the curved surface of the chute is described by a B-spline function F1 having a knot sequence given by K1=[0 0 0 0 κ l l l l], where 0 is the origin, κ is a sliding knot controlling the curvature, and l is the horizontal dimension of the chute, and wherein the curved surface is further specified by the following constraints: F1(0)=0, F1(l)=h, F1 (κ)=κ, DF1(l)=tan α, DF1(0)=tan β, with F1(0)=0 corresponding to the distal end of the chute where said products (1) leave the chute, F1(l)=h corresponding to the receiving end of the chute where said products enter the chute, F1(κ)=κ γ corresponding to the position of the sliding knot controlling the curvature of the chute, DF1(l)=tan α being the first derivative of the function F1 at the receiving end of the chute and the angle α being indicative for the slope of the chute at the receiving end, and DF1(0)=tan β being the first derivative of F1 at the distal end of the chute and the angle β indicative for the slope of the chute at the distal end.

3. The method according to claim 2, wherein the second derivative of said B-spline function F1 is equal to or greater than zero.

4. The method according to claim 1, wherein the chute as provided has:

a height of 0.1 m to 1.2 m;

a width of 0.05 m to 0.4 m; and an angle α, which is indicative for the slope of the chute at the receiving end, and which is 70 to 90 degrees.

5. The method according to claim 1, wherein the chute is positioned on one side of said product stream and the removal system is positioned at the opposite side of said product stream.

6. The method according to claim 1, wherein the removal system comprises a manifold of air-pressure valves, and wherein each of the valves has an effective removal area which is not substantially larger than a size of a typical individual product.

7. The method according to claim 1, wherein the detection system comprises a light source and a detector, and wherein the analyzing step comprises directing a concentrated light beam generated by the light source in a given path across the continuous stream of products to illuminate the individual products, and receiving—by the detector—light reflected from the individual products which have been illuminated.

8. An apparatus for sorting products, comprising:

a detection system;

at least one removal system;

a supply system for providing products in a continuous stream to a chute, the chute having a receiving end and a distal end located below the receiving end, the chute having an upwardly curved surface extending between the receiving end and the distal end, the surface being shaped to define a product path curving upwardly along the surface of the chute and after the products leave the chute at the distal end, the product path having a convex portion extending at the distal end of the chute in a direction below horizontal, the direction of the product path at the distal end of the chute being defined by an angle between horizontal and a tangent to the chute at the distal end of 40-85 degrees, and an essentially vertical portion along a downward path;

the chute being configured to guide said products while moving under gravity, towards the detection system and the at least one removal system, said detection system being positioned to analyze said products when propagating along the product path in the essentially vertical direction.

* * * * *